United States Patent [19]

Reeves et al.

[11] Patent Number: 4,892,784

[45] Date of Patent: Jan. 9, 1990

[54] SURFACE TREATMENT FOR INHIBITING THERMAL OXIDATION OF POLYPROPYLENE FABRICS

[75] Inventors: William G. Reeves, Woodstock; Robert J. Roeder, Roswell; Leonard E. Duello, Woodstock, all of Ga.

[73] Assignee: Kimberly-Clark Corporation, Neenah, Wis.

[21] Appl. No.: 224,835

[22] Filed: Jul. 27, 1988

[51] Int. Cl.[4] ..... B05D 1/18; B05D 3/02; D04H 1/58

[52] U.S. Cl. ..... 428/288; 428/289; 427/384; 427/430.1

[58] Field of Search ..... 427/384, 430.1; 428/288, 289

[56] References Cited

U.S. PATENT DOCUMENTS

| | | | |
|---|---|---|---|
| 3,682,696 | 8/1972 | Yasuda | 162/158 |
| 3,692,618 | 9/1972 | Dorschner et al. | 161/72 |
| 3,932,330 | 1/1976 | Lakshmanan | 156/334 X |
| 3,978,185 | 8/1976 | Buntin et al. | 264/93 |
| 3,993,655 | 11/1976 | Rasberger et al. | 524/103 X |
| 4,041,203 | 8/1977 | Brock et al. | 428/157 |
| 4,115,605 | 9/1978 | Hultman et al. | 427/377 |
| 4,340,563 | 7/1982 | Appel et al. | 264/518 |

*Primary Examiner*—Michael Lusignan

*Attorney, Agent, or Firm*—William B. Boykin; Joseph P. Harps

[57] ABSTRACT

A process is disclosed for inhibiting thermal oxidative degradation of polypropylene webs results from rinsing the polypropylene webs after washing in an aqueous solution of either dilaurylthiodipropionate (DLTOP) or distearylthiodipropionate (DSTDP). The aqueous solution has a concentration of DLTDP or DSTDP of 5 ppm. The aqueous solution is maintained about 150° F., and the polypropylene web is rinsed or dipped in the aqueous solution until saturated. A polypropylene web is also disclosed which has been treated to inhibit thermal oxidative degradation by the above process.

20 Claims, 1 Drawing Sheet

SURFACE TREATMENT FOR INHIBITING THERMAL OXIDATION OF POLYPROPYLENE FABRICS

BACKGROUND OF THE INVENTION

This invention relates generally to treatments for inhibiting thermal oxidation of polypropylene webs and more particularly a surface treatment for inhibiting thermal oxidation of polypropylene webs which can be applied to the polypropylene webs as a rinse after the polypropylene webs have been washed.

Webs made of polypropylene fibers are useful in a variety of applications in the home, in industry, and in the medical field. Such webs can be formed either of discrete microfibers by means of a melt-blown process as taught in U.S. Pat. No. 3,978,185 to Buntin, et al., or can be formed of continuous filaments by means of a spun-bond process as taught in U.S. Pat. No. 3,692,618 to Dorschner, et al. or U.S. Pat. No. 4,340,563 to Appel, et al., all of which patents are hereby incorporated by reference. Both the melt-blown process and the spun-bond process are well known in the art, and by varying the process parameters for each process, a wide variety of polypropylene webs can be made having characteristics particularly suitable to a large number of applications. In addition, additional characteristics for polypropylene webs can be achieved by laminating combinations of melt-blown and spun-bonded polypropylene webs as taught, for example, by U.S. Pat. No. 4,041,203 to Brock, et al. which is hereby incorporated by reference.

Polypropylene material is, however, unstable and will oxidize and decompose when exposed to air. As a result, stabilizers are conventionally blended with the polypropylene during the process of manufacturing the polypropylene beads which are used as the starting material for manufacturing polypropylene webs. Such internal stabilizers, however, are consumed in the act of stabilization and therefore, all webs composed of polypropylene will sooner or later decompose if exposed to air. Decomposition, of course, is faster at higher temperatures and with greater surface area. Thermal oxidative degradation of the polypropylene materials is further accelerated by washing the materials which tends to leach the internal stabilizers out of the microfibers.

In medical applications, polypropylene fabrics often have a very high surface to volume ratio and are often subjected to steam sterilization and drying for extended periods of time, all of which contributes to thermal oxidative degradation. In addition, polypropylene webs are precluded from some medical uses such as newborn baby blankets which are typically stored in warmers for extended periods.

We have found that the thermal oxidative degradation phenomenon cannot be satisfactorily inhibited by simply adding more internal stabilizers to the polymer before extrusion and forming into webs. It appears that such an approach fails for two reasons. First, the exponential decay of the internal stabilizers is so great that it is not physically possible to add enough of the stabilizers to the polymer beads. Second, higher levels of internal stabilizer cause yellowing of the polypropylene fabrics during shipment and storage.

We have also discovered that is virtually impossible to provide an effective internal stabilizer that will not be leached out of microfibers during laundering.

SUMMARY OF THE INVENTION

It is therefore an object of the present invention to provide a method for treating polypropylene fabrics to inhibit thermal oxidative degradation.

It is specifically an object of the present invention to provide a surface treatment for polypropylene fabrics which can be added to the polypropylene fabrics as a rinse after washing of such polypropylene fabrics.

In order to realize the stated objects of the present invention, we have discovered that thermal oxidative degradation of polypropylene fabrics can be inhibited by treating the surface of the polypropylene fabric with an aqueous rinse solution of dilaurylthiodipropionate (DLTDP), or with an aqueous solution of the related compound, distearylthiodipropionate (DSTDP). We have found that such treatment can be carried out at about 150° F. with DLTDP or DSTDP in aqueous solutions having concentrations of 10 parts per million (ppm). Satisfactory results can also be achieved at even lower concentrations by adding 0.6% by weight DLTDP or DSTDP based on the weight of polypropylene material being laundered in a commercial washing machine (which produces a concentration of approximately 5 ppm of DLTDP or DSTDP).

Other objects and advantages of the invention will become apparent upon reading the following detailed description and upon reference to the drawings.

DESCRIPTION OF THE PREFERRED EMBODIMENTS

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
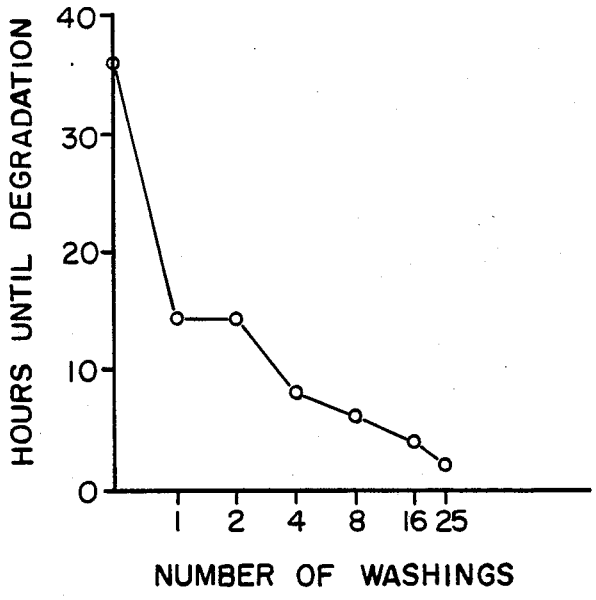
FIG. 1 is a graph showing the thermal oxidative degradation phenomenon for polypropylene materials as function of the number of washings.

FIG. 1 is a graph of the data in Table I, below, showing the thermal oxidative degradation of a polypropylene fabric which is not treated in accordance with the present invention. The polypropylene fabric is a commercial fabric manufactured by the assignee of the present invention for use in the medical field. The fabric comprises a laminate of spun-bond, melt-blown, and spun-bond polypropylene layers. The fabric has a very high surface to volume ratio and therefore is particularly susceptible to thermal oxidative degradation. The thermal oxidative degradation was accelerated by maintaining the fabric samples at a temperature of 275° F. until the samples decomposed. The number of hours required for decomposition is measured along the ordinate of the graph in FIG. 1, and the number of washings to which each sample was subjected is shown along the abscissa of the graph of FIG. 1.

TABLE I

| Hours Until Degradation | Number of Washings |
|---|---|
| 36 | 0 |

TABLE I-continued

| Hours Until Degradation | Number of Washings |
|---|---|
| 14 | 1 |
| 8 | 4 |
| 6 | 8 |
| 4 | 16 |
| 2 | 25 |

When the fabric sample is not washed, it takes over thirty hours for the fabric sample to decompose at 275° F. An identical fabric sample subjected to one washing decomposes in about fifteen hours, and an identical fabric sample subjected to four washings decomposes in less than ten hours. It can be seen, therefore, that washing the fabric apparently leaches the internal stabilizer from the polypropylene microfibers. Consequently after only four washings the fabric sample is no longer suitable for most uses in the medical field where elevated temperatures in processes such as sterilization or warmers may be encountered.

In order to overcome the thermal oxidative degradation problem illustrated by FIG. 1, we have discovered that using a post-washing aqueous rinse solution containing dilaurylthiodipropionate (DLTDP), or the related compound distearylthiodipropionate (DSTDP), to treat the surface of the polypropylene fabric is highly effective in protecting the polypropylene fabric from thermal oxidative degradation.

The preferred minimum rinse solution for inhibiting thermal oxidative degradation is about 0.6% DLTDP by weight per pound of polypropylene fabric being washed in a commercial washing machine. Such a solution has a concentration of about 5 ppm by volume of DLTDP. We have also used rinse solutions having 10 ppm DLTDP in solution, which is twice the concentration of the preferred rinse solution. DSTDP operates within approximately the same concentrations as DLTDP. It is believed that higher concentrations will not provide any significant improvement over the 10 ppm of DLTDP in solution, and at substantially higher concentrations the DLTDP and DSTDP may degrade the other surface properties of the polypropylene.

The process for treating the surface of the polypropylene fabric with DLTDP or DSTDP simply requires that the appropriate solution of DLTDP or DSTDP be added to the final rinse of the wash cycle of a commercial washing machine in which the polypropylene fabrics are being laundered. While the normal rinse cycle for such a commercial washing machine may last several minutes, it is believed that the advantages of the treatment can be realized by simply dipping the polypropylene web in the properly formulated rinse solution for a time sufficient to saturate the polypropylene web. In addition the rinse solution should be maintained at a minimium temperature of 150° F.

Figure 2:
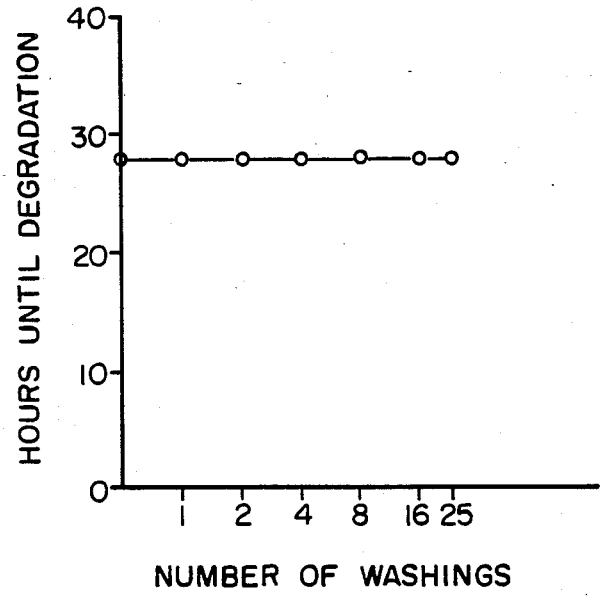
FIG. 2 is a graph showing the thermal oxidative degradation of polypropylene fabric as a function of the number of washings where the fabric has been treated in accordance with the present invention.

Based on our work with DLTDP rinses, we have experienced results such as those shown in FIG. 2, which is a graph of the data in Table II, below. If the polypropylene web is rinsed with the preferred rinse solution after each washing, the thermal oxidative degradation of the polypropylene fabric at 275° F. is maintained at a constant level of about 28 hours. Such a level is within the same range as unwashed polypropylene fabrics indicating that the surface treatment of the present invention can essentially eliminate the effect of loss of stabilizer due to washing.

TABLE II

| Hours Until Degradation | Number of Washings |
|---|---|
| 28 | 0 |
| 28 | 1 |
| 28 | 2 |
| 28 | 4 |
| 28 | 8 |
| 28 | 16 |
| 28 | 25 |

Although DLTDP and DSTDP are used as internal stabilizers for polypropylene, we believe that the mechanism for surface treatment stabilization is different from the mechanism for internal stabilization. For example, other well known internal stabilizers for polypropylene simply do not work when used as a surface treatment. Tinuvin 622, manufactured by Ciba-Geigy, is ineffective as a stabilization booster when used as discussed above. Tinuvin 756, which is water soluble, provided only 8 hours of protection from thermal oxidative degradation after washing and surface treatment. In addition, it adversely affected the static discharge properties of the web, thereby making the web unsuitable for many medical applications. Irgastaab 2002, manufactured by Ciba-Geigy, produced a serious loss of water repellency and provided no better than 8 hours of protection from thermal oxidative degradation after washing and surface treatment. Chimosorb 944, manufactured by Ciba-Geigy, provided some protection against thermal oxidative degradation, but not nearly as much as the present invention. Chimasorb 944 also produced a serious loss of static discharge capability in the fabric.

We have also found that DLTDP and DSTDP are compatible with other additives which are used as surface treatments in the medical field to provide electrical conductivity and alcohol repellency of polypropylene webs.

We claim:

1. A process for inhibiting thermal oxidation of polypropylene fabrics comprising the steps of:
   - preparing an aqueous solution having a concentration of greater than about 5 ppm of dilaurylthiodipropionate;
   - heating the aqueous solution to at least 150 degrees F.;
   - saturating the polypropylene fabric with the heated aqueous solution; and allowing the fabric to dry to substantially remove the water therefrom.

2. The process of claim 1, wherein the aqueous solution has a concentration of greater than about 10 ppm of dilaurylthiodipropionate.

3. A process for inhibiting thermal oxidation of polypropylene fabrics comprising the steps of:
   - preparing an aqueous solution having a concentration of greater than about 5 ppm of distearylthiodipropionate;
   - heating the aqueous solution to at least 150 degrees F.;
   - saturating the polypropylene fabric with the heated aqueous solution; and allowing the fabric to dry to substantially remove the water therefrom.

4. The process of claim 3, wherein the aqueous solution has a concentration of greater than about ppm of distearylthiodipropionate.

5. The polypropylene fabric formed from the process of claim 1.

6. The polypropylene fabric formed from the process of claim 3.

7. A process for inhibiting thermal oxidation of polypropylene fabrics comprising the steps of:

preparing an aqueous solution having a concentration of greater than about 5 ppm to about 10 ppm of dilaurylthiodipropionate;

heating the aqueous solution to at least 150 degrees F.;

saturating the polypropylene fabric with the heated aqueous solution; and allowing the fabric to dry substantially remove the water therefrom.

8. The process of claim 7, wherein the fabric is a laminate of spun-bond, meltblown and spun-bond polypropylene layers.

9. The process of claim 7, wherein the fabric is a nonwoven web.

10. The process of claim 9, wherein the nonwoven web is selected from the group consisting of meltblown webs or spun-bonded webs.

11. A process for inhibiting thermal oxidation of polypropylene fabrics comprising the steps of:

preparing an aqueous solution having a concentration of greater than about 5 ppm to about 10 ppm of distearylthiodipropionate;

heating the aqueous solution to at least 150 degrees F.;

saturating the polypropylene fabric with the heated aqueous solution; and allowing the fabric to dry to substantially remove the water therefrom.

12. The process of claim 11, wherein the fabric is a laminate of spun-bond, meltblown and spun-bond polypropylene layers.

13. The process of claim 11, wherein the fabric is a nonwoven web.

14. The process of claim 13, wherein the nonwoven web is selected from the group consisting of meltblown webs or spun-bonded webs.

15. The process of claim 1, wherein the fabric is a laminate of spun-bond, meltblown and spunbond polypropylene layers.

16. The process of claim 1, wherein the fabric is a nonwoven web.

17. The process of claim 16, wherein the nonwoven web is selected from the group consisting of meltblown webs or spunbonded webs.

18. The process of claim 3, wherein the fabric is a laminate of spun-bond, meltblown and spun-bond polypropylene layers.

19. The process of claim 3, wherein the fabric is a nonwoven web.

20. The process of claim 19, wherein the nonwoven web is selected from the group consisting of meltblown webs or spunbonded webs.

* * * * *

UNITED STATES PATENT AND TRADEMARK OFFICE

CERTIFICATE OF CORRECTION

PATENT NO. : 4,892,784

DATED : January 9, 1990

INVENTOR(S) : William G. Reeves, et al

It is certified that error appears in the above—identified patent and that said Letters Patent is hereby corrected as shown below:

Title page:

In the 4th line of the Abstract of the Disclosure (DLTOP) should read (DLTDP)

In Column 3, Table I, a line of data was omitted at the page break. In the left column, insert 14 between 14 and 8, and in the right column, insert 2 between 1 and 4.

In Column 5, line 13 "substantially remove the water therefrom." should read "to substantially remove the water therefrom."

Signed and Sealed this

Eighth Day of January, 1991

*Attest:*

HARRY F. MANBECK, JR.

*Attesting Officer*

*Commissioner of Patents and Trademarks*